US008466772B2

(12) United States Patent
Szwarc et al.

(10) Patent No.: US 8,466,772 B2
(45) Date of Patent: Jun. 18, 2013

(54) PRECISION VARIABLE RESISTOR

(75) Inventors: Joseph Szwarc, Ramat Gan (IL); Jean-Michel Lanot, Nice (FR); Felix Zandman, Malvern, PA (US); Ruta Zandman, legal representative, Bala Cynwyd, PA (US)

(73) Assignee: Vishay Israel, Ltd, Holon (IL)

( * ) Notice: Subject to any disclaimer, the term of this patent is extended or adjusted under 35 U.S.C. 154(b) by 69 days.

(21) Appl. No.: 13/060,872

(22) PCT Filed: Feb. 17, 2009

(86) PCT No.: PCT/IL2009/000183

§ 371 (c)(1),
(2), (4) Date: Feb. 25, 2011

(87) PCT Pub. No.: WO2010/023651

PCT Pub. Date: Mar. 4, 2010

(65) Prior Publication Data

US 2012/0112874 A1 May 10, 2012

Related U.S. Application Data

(60) Provisional application No. 61/092,074, filed on Aug. 27, 2008.

(51) Int. Cl.
*H01C 10/44* (2006.01)

(52) U.S. Cl.
USPC ..... 338/183; 338/188; 338/195

(58) Field of Classification Search
USPC ..... 338/183, 188
See application file for complete search history.

(56) References Cited

U.S. PATENT DOCUMENTS

| | | | | |
|---|---|---|---|---|
| 3,405,381 | A | 10/1968 | Zandman et al. | |
| 3,601,744 | A | 8/1971 | Zandman | |
| 3,821,845 | A | 7/1974 | Hukee et al. | |
| 4,134,096 | A * | 1/1979 | Denes | 338/195 |
| 4,243,969 | A * | 1/1981 | Steigerwald et al. | 338/309 |
| 4,677,413 | A | 6/1987 | Zandman et al. | |

(Continued)

FOREIGN PATENT DOCUMENTS

| | | |
|---|---|---|
| DE | 9420887 | 2/1995 |
| EP | 0323943 | 7/1989 |
| FR | 1185011 | 7/1959 |
| WO | 9509428 | 4/1995 |

OTHER PUBLICATIONS

Machine translation of EP0323943. Jul. 12, 1989.*

(Continued)

*Primary Examiner* — Kyung Lee
(74) *Attorney, Agent, or Firm* — Volpe and Koening P.C.

(57) ABSTRACT

On the track of a potentiometer a resistive path of thin film is deposited or a foil is bonded to a matched substrate and a parallel path is formed of discrete contact straps extending from the resistive path. The resistive path has a protecting coating and the wiper is moving on abrasion resistant contact straps. This design enables application of high precision and stability resistor technologies in the production of variable resistors destined for long service life. It enables also, in high precision applications, by maintaining the linearity of the output versus input function, a two-wire connection to the variable resistor used as a position sensor.

21 Claims, 8 Drawing Sheets

U.S. PATENT DOCUMENTS

| | | | | |
|---|---|---|---|---|
| 5,119,063 | A * | 6/1992 | Nonnenmacher et al. | 338/159 |
| 5,243,318 | A * | 9/1993 | Greenstein | 338/195 |
| 5,258,737 | A | 11/1993 | Wanja | |
| 5,343,188 | A | 8/1994 | Yasuda et al. | |
| 5,554,965 | A * | 9/1996 | Sundberg | 338/160 |
| 6,369,690 | B1 * | 4/2002 | Chen | 338/160 |
| 6,518,873 | B1 * | 2/2003 | O'Regan et al. | 338/190 |
| 7,541,911 | B2 * | 6/2009 | Kawaguchi et al. | 338/330 |

OTHER PUBLICATIONS

International Search Report, Vishay Israel Ltd., PCT/IL2009/000183, Feb. 17, 2009, 3 pages.

Kestenbaum, Trimming behavior and Post-Trim Characteristics of Ta2N Resistors on Silicon, IEEE Transactions on Components, Hybrids, and Manufacturing Technology, Dec. 1980, vol. CHMT-3, No. 4.

* cited by examiner

CROSS SECTION AA'

PRECISION VARIABLE RESISTOR

FIELD OF THE INVENTION

The present invention relates to precision variable resistors destined for long service life and low power applications, the variable resistors used as movement transducers/position sensors in electronic circuits and answers a need of weight reduction and increased reliability, for instance for airborne applications.

BACKGROUND AND PRIOR ART

Variable resistors are based on an electro-resistive element called Potentiometer track. A potentiometer is constructed using a resistive element, with a sliding contact ("wiper"), whereas the wiper can slide over the resistive element ("track", "resistive path"). The end points of the resistive path provide two terminal end points and the wiper provides the third terminal.

Variable resistors are commonly used in an electronic circuit either in a 3 lead wires potentiometer mode or in a 2 wires rheostat mode. In the first mode, herein referred to as "potentiometer" mode, an input voltage is applied to end points of the track and the output is a partial voltage at wiper terminal, wherein the output voltage is a function of the position of the wiper on the track.

In the second mode, herein referred to as "rheostat" mode, a variable resistor is obtained between one end point terminal of the track and the wiper terminal, while the second end point of the track can be left open or short-circuited with the terminal post of the wiper.

A rheostat mode application is described in U.S. Pat. No. 5,343,188 ('188) given to Yasuda et al. Reference is now made to FIG. 1 (prior art), which is an electrical schematic of a slide rheostat 20 as provided by '188. Three resistors are produced on a common substrate 28 using the same resistive material: a resistor track having a total resistance of Rt, having two end point terminal 24 and two load resistors RL1 and RL2 (called "clamping resistors") connected at each end point 24 of resistor Rt. Wiper 22 slides over track Rt, thereby dividing track Rt into two segments, whereas the resistance of the segment between the terminal of wiper 22 ("rheostat track") and end point terminal 24*a* is Rx. Five possible wires can come out of slide rheostat 20: $L_1$, out of $R_{L1}$; $L_2$, out of end point terminal 24*a*; $L_W$, out of the terminal of wiper 22; $L_3$, out of end point terminal 24*b*; and $L_4$, out of $R_{L2}$. The wires ($L_1$, $L_2$, $L_3$. $L_4$ and $L_W$) are leading to a voltage source. A processing unit provides output voltages related to the position of wiper 22 and indicates that there is no short circuit or no open circuit in the rheostat track. The load resistors and the rheostat track have similar temperature dependence (TCR), but the difference between the temperatures depends on the wiper's position due to changing heat dissipation pattern.

The present invention mentions also the rheostat mode, but both the goal and the construction are different: two wires leading from Rx on the rheostat track to a remote load resistor allow a reduction in the weight of wiring and all resistors are of a high precision and stability class required to maintain the high accuracy of the electric output versus wiper's position relationship. The accuracy of the relationship depends on accuracy and stability of all components.

The requirements in applications of high precision variable resistors are:

a) High reliability over a long service life;
b) High precision of resistance value as measured between end points 24;
c) High stability of resistance when ambient temperature changes and after a long service life;
d) High resolution—capability of fine adjustment;
e) Linearity—how well the measured output fits the specified linear or other function of electrical output versus the position of wiper 22; and
f) Low and stable contact resistance of wiper 22.

Four prevalent technologies used in production of the tracks are cermet (paste of glass and conductive particles, screen printed and fired), composition (polymer with conducting particles), wire-wound and foil. In prior art thin film technology is not used because the thin film is easily abraded by the moving wiper 22.

The first two are not suitable for high stability applications due to two types of changes in the resistance values: a reversible change with changing temperature (high temperature coefficient of resistance (TCR)) and a permanent one, with load and time. Cermet resistors have better specifications than composition and have TCR between 50 and 250 ppm/° C. and tolerances of 1% to 5%.

For fixed value resistors of higher precision, thin film technology provides TCR between 5 and 25 ppm/° C., but is not used in variable resistors because the thin film is easily abraded by the moving wiper.

The fixed value foil resistors are available with TCR down to less than 1 ppm/° C. and tolerances down to 0.001%, and foil variable resistor tracks (see ref. 2) provide a high stability and resolution, but have a limited service life and are used only as precise trimming potentiometers (trimmers) which are only occasionally adjusted.

According to prior art, some increase in life expectancy is achieved by use of special lubricants.

Precision foil resistor with very low TCR are described in U.S. Pat. No. 4,677,413 ('413), given to Felix Zandman et al, the disclosure of which is incorporated herein by reference for all purposes as if entirely set forth herein.

U.S. Pat. No. 3,821,845 ('845), Given to Hukee et al, describes a method by which a computerized probing board is mapping sections of the resistive film and a laser beam is cutting into the film to increase the segment's resistance. Such cutting mode introduces instability of the resistance value by creating heat affected zones at the end of laser cuts, were the current density is increased. The resistance drift, obtained after a laser cut is also described in IEEE Transactions on Components, Hybrids, & Manufacturing Technology by A. Kestenbaum et. Al., December 1980, V.3, Is. 4, pages 637-648, "Trimming Behavior and Post-Trim Characteristics of Ta2N Resistors on Silicon", which is incorporated herein by reference.

Typically, wire-wound tracks have poor resolution: the device lacks electrical and mechanical smoothness of operation—wiper 22 jumps from one wire to the next, creates an electrical output of large steps as a function of the position of wiper 22 and fine adjustment is not possible. Wire-wound tracks are mainly used for higher power applications U.S. Pat. No. 3,601,744 ('744), given to Felix Zandman, and U.S. Pat. No. 3,405,381, given to Felix Zandman et al, the disclosure of which are incorporated herein by reference for all purposes as if entirely set forth herein, suggest resistors having foil tracks that provide a high stability and resolution, but have a limited service life and are used only as precise trimming potentiometers (trimmers) which are only occasionally adjusted.

There is therefore a need and it would be advantageous to have a high accuracy variable resistor and a two-wire position sensor, the latter especially for applications of position sensing requiring reduction of the weight of wiring. Furthermore, it would be advantageous to provide variable resistor tracks of long service life, high precision, high stability, low contact resistance, high resolution and linearity using existing precision resistors production technologies.

The quality of variable resistors in terms of precision, stability and length of service life is today limited due to characteristics of resistive materials employed and their abrasion by a wiper moving on the resistive path. Attempts are made to remove the debris created by this abrasion but it doesn't reduce the resistance shift caused by the abrasion. U.S. Pat. No. 5,258,737, given to Roland Wanja, provides a potentiometer, which avoids problems caused when abraded material which collects on the surface of the potentiometer track as a result of friction between the wiper contact and the potentiometer track, causing an undesirable increase in the contact resistance. In another example international patent application WO 1955/009428 by Michael Cairns et al, provides a potentiometer less liable to produce transient voltage spikes caused by its contacts being lifted from the track of electro-resistive material when encountering detritus or dust uses slider contacts having divergent contact areas.

Prior art potentiometers for long term life use resistive materials of type not suitable for high precision and stability, which characteristics can be met by the use of thin film and even more so by foil technology, but these are not suitable for long term abrasion by a sliding wiper. FIG. 2 (prior art) illustrates potentiometer track 30, having two terminal pads 34 and a meandering resistive path 36 composed of vertical lines which are connected by top end loops 38*a* and bottom end loops 38*b*.

In a rotary potentiometer a flexible substrate enables bonding of such a track to the wall inside a cylindrical housing, and a contacting wiper attached to a rotating arm slides along track 30 and contacts also an electrical output terminal on the housing. Alternative designs use a planar track with an arc shaped pattern (see '744).

FIG. 3 (prior art) illustrates potentiometer track 40, having two terminal pads 44 and two meandering resistive paths 46, respectively, connected in parallel by end-loops 48: Bottom end-loops 48*b* of the upper meander path 46 contact top end-loops 48*a* of the lower meander path 46*b*, at the horizontal center-line of potentiometer 40. Such arrangement of two (or more) meanders 46 in parallel has the advantage of avoiding a catastrophic failure caused by a discontinuity in the resistive path. To cause an open circuit, both meanders 46 must be cut between two adjacent end loops common to the two meanders. Addition of parallel meanders causes also a reduction of the track's resistance value.

FIG. 4 (prior art) illustrates potentiometer track 50, having two terminal pads 54, meandering resistive path 56 and a collector bar 52 having a lead wire connected to collector bar 52 and serving as the output terminal. Collector bar 52, having an output lead wire, is serving as the third terminal. The resistance of collector bar 52 plays a minor role in the potentiometer mode, but may be harmful in the rheostat mode as it adds to wiper's 22 contact resistance.

There is therefore a need and it would be advantageous to be able to eliminate the wear of the resistive material and to enable the use of high precision and stability resistive materials.

SUMMARY OF THE INVENTION

The principal intentions of the present invention include providing a variable resistor of high precision and stability, having a resistive track, two terminal pads respectively connected to each end of the track, a wiper and a mechanism for moving the wiper, a housing and electrical connections connecting one or both of terminal pads and the wiper with an external circuit. The track includes a substrate having a layer of resistive material of high precision and stability, which is connected to the substrate and forms a resistive path.

In variations of the present invention, the resistive layer is thin film or foil, both materials of the type used for production of high precision fixed value resistors. The thin film or foil, provide the precision and stability which are not achievable with materials currently used in variable resistors destined for a long service life.

According to the teachings of the present invention, the precision variable resistor includes a plurality of contact straps extending along the track.

The contact straps have insignificant electrical resistance and high abrasion resistance, wherein the contact straps operatively provide an electrical connection between the wiper and different locations along the resistive path during the wiper's movement on the contact straps. The imaginary line drawn by the wiper when moving from one terminal pad to the other is referred herein as the "longitudinal axis" of the track. The contact straps are typically arranged in a row and disposed perpendicularly or slightly skewed with respect to the longitudinal axis of the resistive path and between the terminal pads.

The mechanism for moving the wiper enables operative motion of the wiper on the contact straps and the position of the wiper on the contact straps defines the resistance of the variable resistor. Hence, the wiper travels on the row of the contact straps rather than on the resistive path, the contact straps being electrically connected to the resistive path.

The contact straps are of substantially even width and are disposed on the resistive path with substantially even gaps.

An aspect of the present invention is to provide a precision variable resistor wherein the resistive path is coated with an insulating layer and thereby providing protection against humidity and chemicals.

An aspect of the present invention is to provide a precision variable resistor, wherein resistive material of the track has resistance versus temperature characteristic, as defined by the temperature coefficient of resistance (TCR), of less than 50 parts per million per degree centigrade (ppm/° C.) and of end of life stability of 1% or better.

An aspect of the present invention is to provide a precision variable resistor, wherein the substrate of the track is made of isolating materials, selected from the group including rigid materials such as ceramic, flexible materials such as epoxy glass or another polymeric film or laminate, or a metal shim with an isolating film.

An aspect of the present invention is to provide a precision variable resistor, wherein the contact straps are processed to provide an abrasion resistant surface. For example, plating the contact straps with precious metal or alloy and thereby providing low contact resistance. The metal or alloy can be alloys of gold or other metals used for plating electrical contacts.

According to aspects of the present invention, the electrical output during the travel of the wiper on the contact straps, between the two terminal pads, fits a specified output function, such as linear function, wherein the output function defines the relationship between the position of the wiper on the track and the electrical output.

An aspect of the present invention is to provide a precision variable resistor, wherein the resistive layer of thin film or foil is processed to have a TCR which matches the temperature coefficient of expansion (TCE) of the substrate or of the housing and thereby obtain an assembled resistive track having a low TCR.

An aspect of the present invention is to provide a precision variable resistor, wherein the resistive layer is patterned to form one or more meandering resistive paths between the two terminal pads and thereby obtain an assembled resistive track having a predefined precise target resistance value between the terminal pads. The meandering resistive paths include calibrating elements enabling the trimming of one or more of the meandering resistive paths, and thereby bring the resistance value to a specified precise target and to improve the fit of the electrical output of the travelling wiper to the output function.

In variations of the present invention, the trimming is performed by cutting one or more shunting bars, thereby increasing the length of the resistive path at a specific location on the resistive path and thereby adjusting the resistance value at the specific location and adjusting the resistance value of the resistive path.

In variations of the present invention, the trimming is performed by cutting into a resistive pattern and thereby reducing the width of the conducting lines of the resistive pattern.

In variations of the present invention, the track further includes probing pads for measuring segments of the resistive path for trimming purposes.

In variations of the present invention, the track further includes protective and reinforcing coating applied onto the group of elements consisting of the patterned meandering resistive paths, portions of the terminal pads and the edges of the contact straps.

It should be noted that the track can form a straight line, or has an arcuate form, or is bent into a form of a cylinder or any other shape. The resistive track can be attached to a flat surface of an electrically isolating housing for linear motion of the wiper, or of arcuate form with radial traces for an angular motion of the wiper, or attached to a flexible substrate, isolating or metallic with an insulating layer and rolled into a cylinder for bonding inside a cylindrical housing.

In variations of the present invention, the electrical connections connect one of the terminal pads and the wiper with an external circuit, wherein the lead wire of the second terminal pad either remains not connected or is short-circuited with the terminal of the wiper, thereby forming a two-wire precision variable resistor.

The two-wire precision variable resistor can be used as a precision position sensor or motion transducer, based on a precise and stable resistance Rx formed between one terminal pad of the track and the wiper. Rx is remotely connected in series with a precise and stable load resistor $R_L$ and with a constant voltage source Vs, forming a voltage divider. The movement of the wiper on the contact straps changes the rheostat's resistance value Rx from zero up to the total resistance Rt of the track. The electric output is remotely sensed as voltage drop $V_L$ over load resistor $R_L$ or as voltage drop $V_X$ over the rheostat resistance Rx. The recording of both $V_L$ and Vx indicates the proper functioning of the readout.

It should be noted that the two-wires connection between the sensing rheostat and the control/processing unit is of special importance in air-borne applications due to a saving in the weight of wiring as compared with the conventional 3 wires of potentiometric position sensors.

BRIEF DESCRIPTION OF THE DRAWINGS

The present invention will become fully understood from the detailed description given herein below and the accompanying drawings, which are given by way of illustration and example only and thus not limitative of the present invention, and wherein.

DESCRIPTION OF THE PREFERRED EMBODIMENTS

Figure 1:
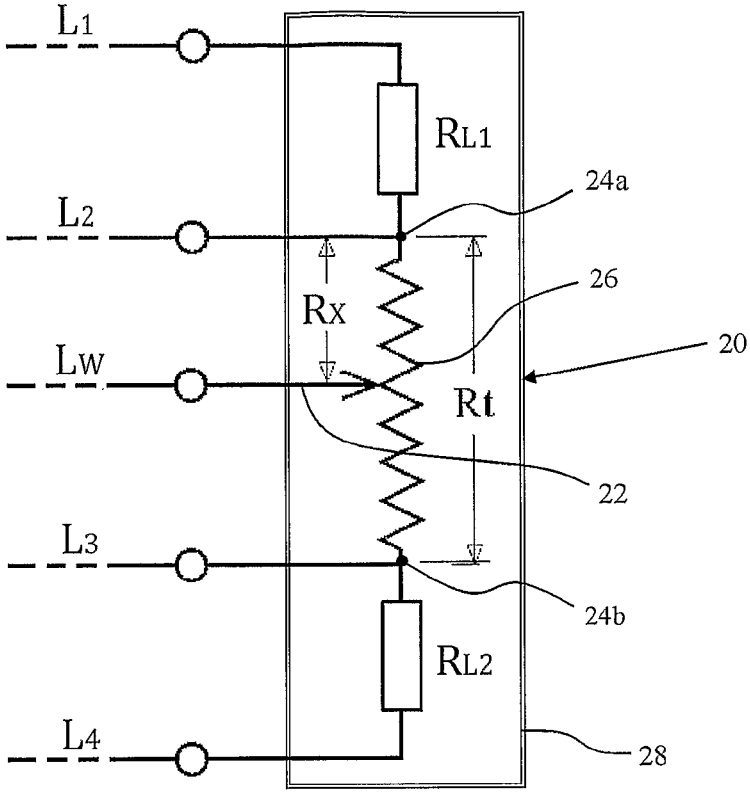
Fig. 1 PRIOR ART
FIG. 1 (prior art) is an electrical schematic of a prior art slide rheostat.
Figure 2:
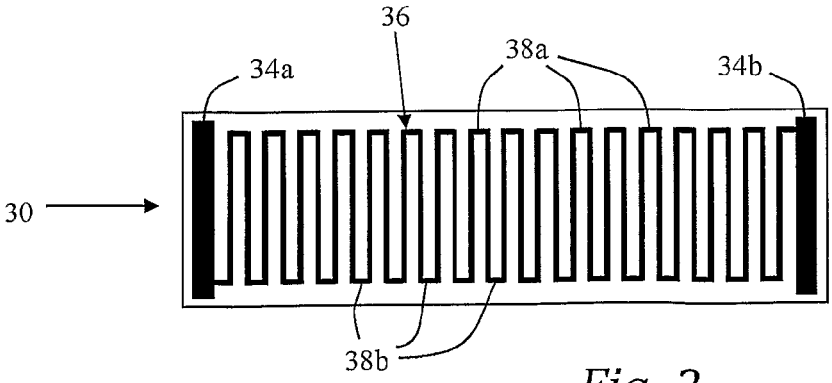
Fig. 2 PRIOR ART
FIG. 2 (prior art) illustrates a potentiometer track, having two terminal pads and a meandering resistive path.
Figure 3:
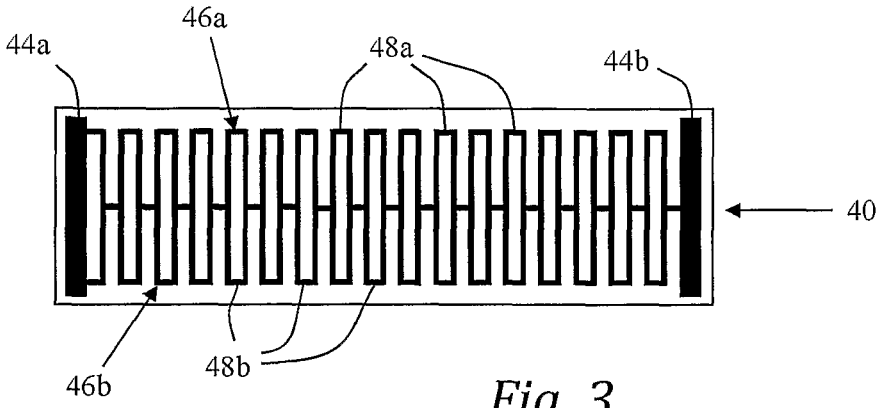
Fig. 3 PRIOR ART
FIG. 3 (prior art) illustrates a potentiometer track, having two terminal pads and two meandering resistive paths connected in parallel.
Figure 4:
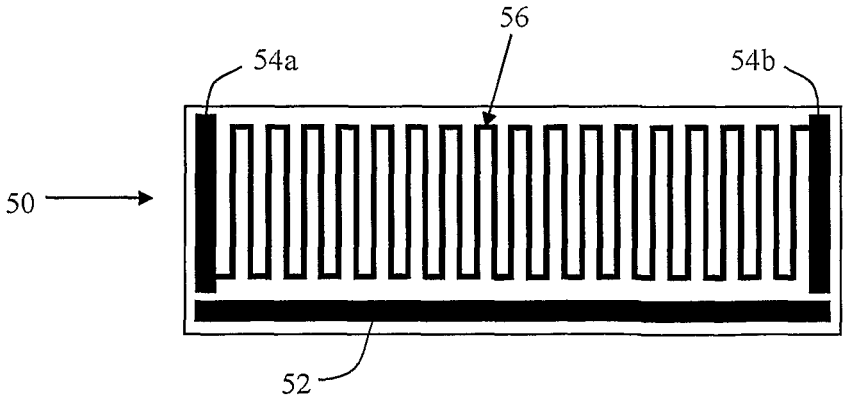
Fig. 4 PRIOR ART
FIG. 4 (prior art) illustrates a potentiometer track, having two terminal pads, a meandering resistive path and a collector bar serving as the output terminal.

Before explaining embodiments of the invention in detail, it is to be understood that the invention is not limited in its application to the details of construction and the arrangement of the components set forth in the host description or illustrated in the drawings.

Unless otherwise defined, all technical and scientific terms used herein have the same meaning as commonly understood by one of ordinary skill in the art to which the invention belongs. The methods and examples provided herein are illustrative only and not intended to be limiting.

A principle intentions of the present invention include providing a variable resistor of high precision and stability, and also a two-wire precision position sensor based on a portion of the precise variable resistance between one terminal pad of a resistive track and the wiper of a rheostat, wherein the lead wire of the second terminal can be short-circuited with the wiper's terminal. The variable resistors of the present invention are of high reliability, precision and stability. A row of contact straps, having insignificant electrical resistance and high abrasion resistance, is extending from the resistive path. The wiper travels on the row of the contact straps rather than on the resistive path, the contact straps being electrically connected to the resistive path. The resistive path can also be coated with an insulating layer for protection against humidity and chemicals.

Figure 5:
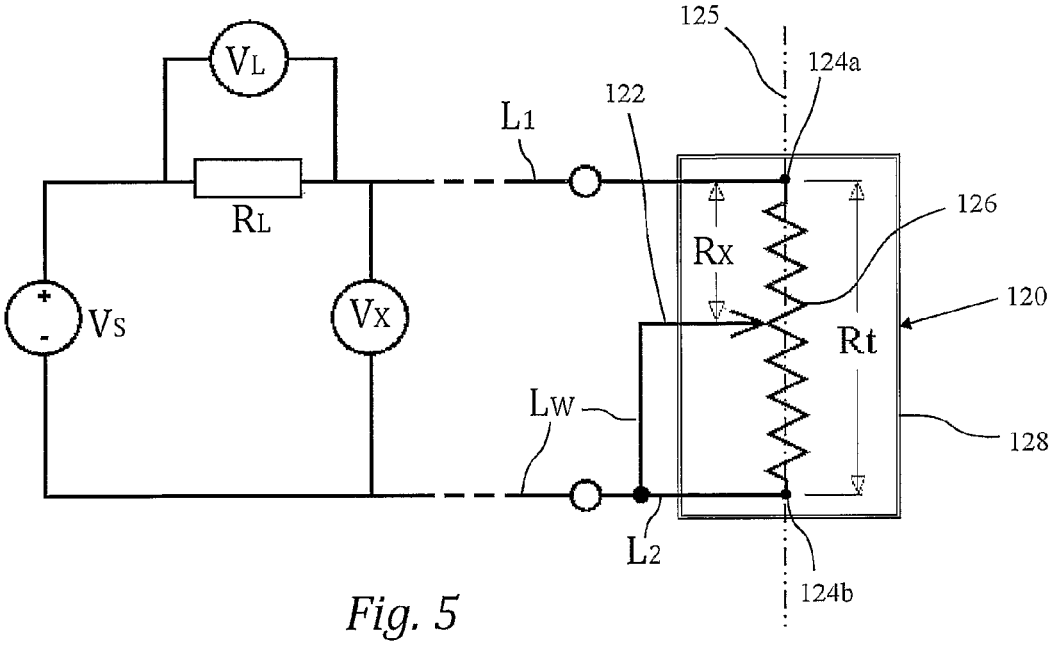
FIG. 5 is an electrical schematic of a two-wire rheostat, utilizing a precision variable resistor, according to embodiments of the present invention.

FIG. 5 is an electrical schematic of a two-wire rheostat 120, utilizing a precision variable resistor 126, according to embodiments of the present invention. Rx is the resistance from a first track end point 124*a* to wiper 122, Rt is the total resistance of track 126 between the two end points 124, $R_L$ is the load resistance, a first lead wire $L_1$, a second lead wire $L_2$ short circuited with $L_W$, $V_L$ is the sensed output voltage and $V_S$ is the constant voltage supplied by a source. Two-wire rheostat 120 is enclosed in a housing. Track 126 has longitudinal axis 125. One end of track 126 is electrically connected in series to load resistance $R_L$ of an external circuit remotely located with respect to two-wire rheostat 120, by lead wire $L_1$. The second end of track 126 is shown short-circuited ($L_2$) with the terminal ($L_W$) of wiper 122, but can also be left open.

Rheostat 120 can be used as a variable resistance and also as a position sensor: rheostat 120 is connected in series with load resistor $R_L$ and constant voltage source Vs. The movement of wiper 122 changes the rheostat's resistance $R_X$ from zero up to the track total resistance Rt. The output is remotely sensed as a voltage drop $V_L$ over load resistance $R_L$ or voltage drop Vx over resistance $R_X$ of rheostat 120. It can also be sensed over both in a way to indicate the proper function of the reading instruments by checking that $V_L+V_X=V_S$.

Variable resistance Rx is obtained between terminal pad 124*a* of a resistive track 126 and wiper 122. The movement of wiper 122 changes resistance Rx from zero up to the track total resistance Rt.

If we express the output $V_L$ sensed over $R_L$ as a ratio $V_L/Vs$ and input as Rx which represents wiper's position, the output function of rheostat 120 is expressed by equation:

$$V_L/Vs=R_L/(Rx+R_L).$$

Similarly, if we choose to measure the output Vx sensed over Rx, the equation becomes:

$$Vx/Vs=Rx/(Rx+R_L).$$

By reading both $V_L$ and Vs and obtaining:

$$(V_L+Vx)/Vs=1,$$

we get an indication of the proper functioning of the reading instruments.

Figure 6A:
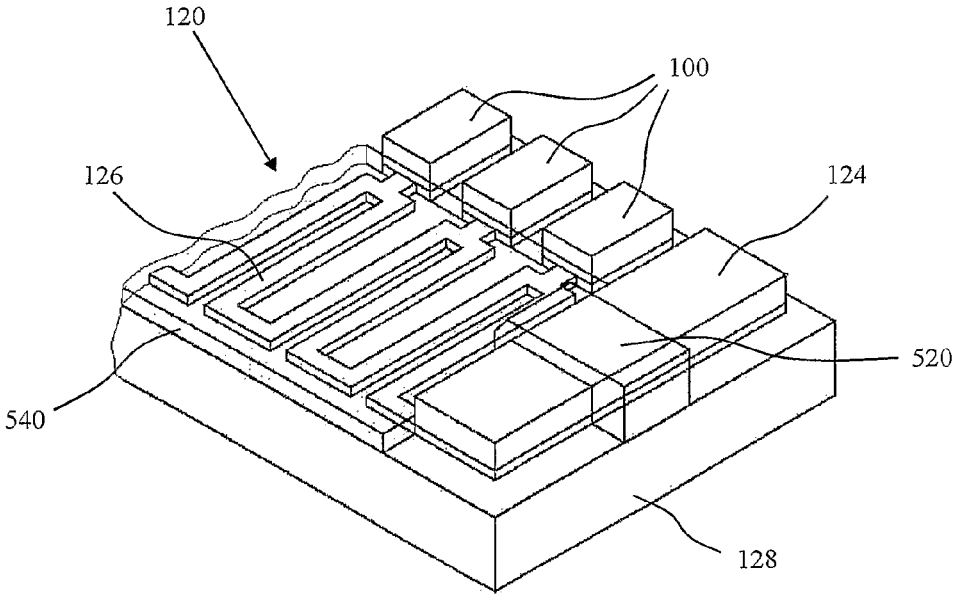
FIG. 6*a* is a perspective view of the end portion of a precision variable resistor, according to variations of the present invention.
Figure 6C:
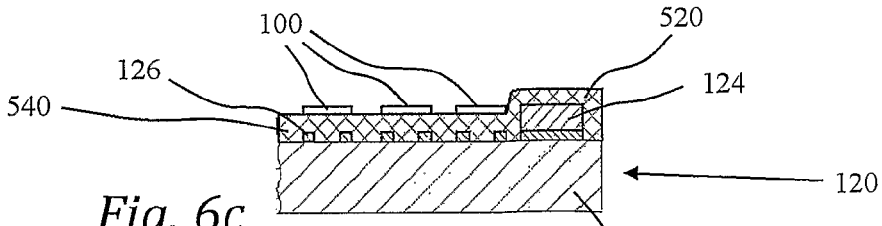
FIG. 6*c* is illustrates cross section AA' of the end portion shown in FIG. 6*b.*
Figure 6B:
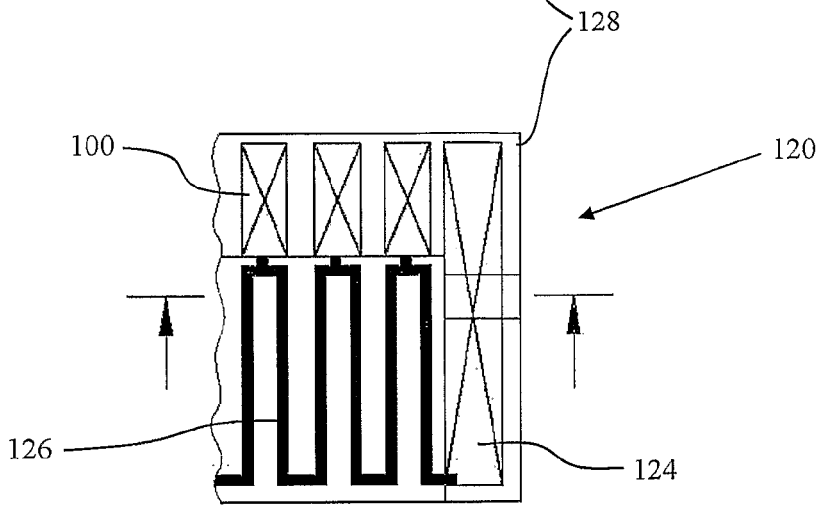
FIG. 6*b* is a top view of the end portion shown in FIG. 6*a;*

FIG. 6*a* is a perspective view of the end portion of rheostat 120, according to embodiments of the present invention. FIG. 6*b* is a top view of the end portion shown in FIG. 6*a* and FIG. 6*c* is illustrates cross section AA' of the end portion shown in FIG. 6*b*. The improved variable resistor track 120 of the present invention includes resistive path 126 consisting of a pattern of deposited thin film or of a foil bonded to substrate 128. The physical properties of the resistive materials and substrates 128 are matched to provide a low TCR, while the resistive material is not contacted and not abraded with time by wiper 122. Instead, a plurality of contact straps 100 extends from resistive path 126, wherein contact straps 100 are preferably plated by deposition, photo-fabrication and/or electro-plating (or other metal plating method). Resistive path 126 is thereby protected with insulating coating 540 against influence of humidity and chemicals and contact straps 100 are made, by proper choice of plating alloys, of low contact resistance and abrasion resistant. For example: the choice of plating can be hard gold or other precious metals or alloys. It should be noted, that for illustrative purposes only, with no limitations, coatings 520 and 540 are shown as transparent materials.

Typically, the contact straps are arranged in a row and disposed perpendicularly or slightly skewed with respect to longitudinal axis 125 of resistive path 126 and between terminal pads 124.

Optionally, wiper 122 moving on the contact straps slides also on a metallic disc or strip fixed to the housing of the variable resistor 120 or can be made to slide also on an additional collector path parallel to and similarly plated as is the row of contact straps.

Figure 7:
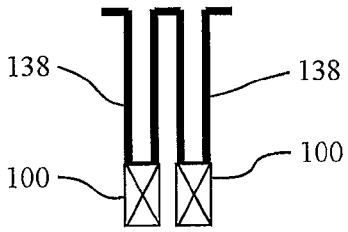
FIG. 7 is an example illustration of two U shaped loops of a meandering resistive path, having a contact strap attached to the bottom of each of the U shaped loops, according to variations of the present invention.

FIG. 7 is an example illustration of two U shaped loops 138 forming a single meander resistive element of resistive path 136, having contact strap 100 attached to the bottom (also referred to as "end loop") of each of end loops 138, according to variations of the present invention. A coupling wiper (122) slides on the row of contact straps 100 rather than on resistive path 136, wherein contact straps 100 are electrically connected to resistive path 136. Durable straps 100 eliminate the wear of the resistive material, enabling provision of protection to resistive path 136 and enabling the use of stable resistive materials of high precision.

Figure 8A:
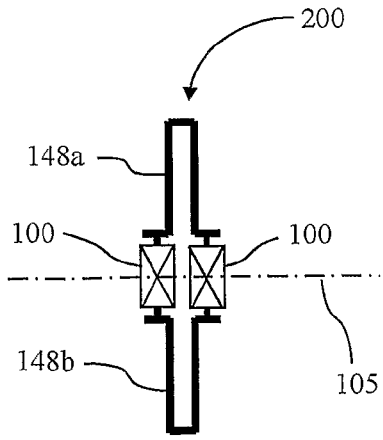
FIG. 8*a* is an example illustration of a module consisting of two parallel loops ("a double loop") of a meandering resistive path, the two loops being electrically connected in parallel by two contact straps disposed at the horizontal center line of the double loop, according to variations of the present invention.
Figure 8B:
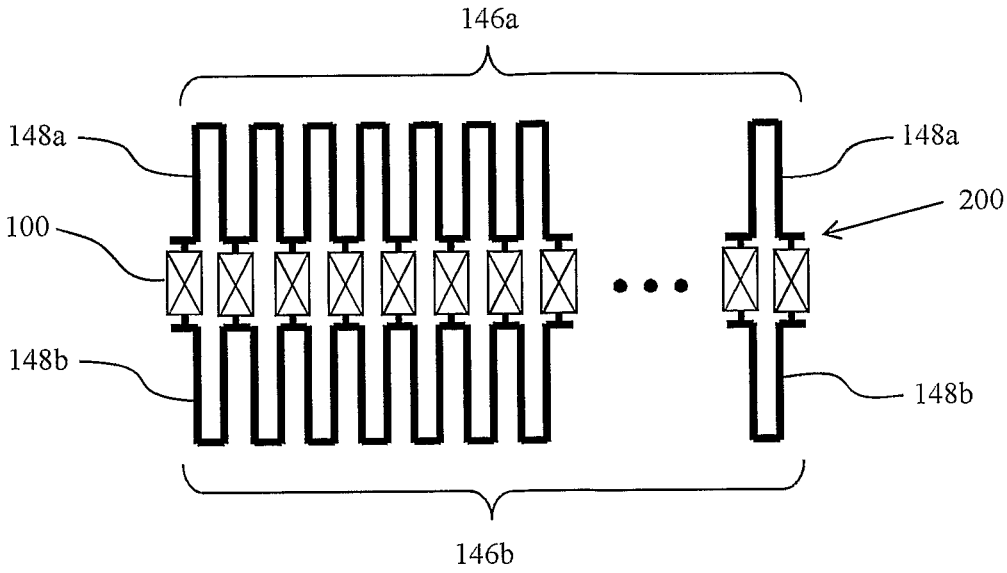
FIG. 8*b* is an example illustration a row of plurality of the double loops shown in FIG. 8*a;*

FIG. 8*a* is an example illustration of module 200, consisting of two loops, ("a double loop") of a meandering resistive path, the two loops 148 being connected in parallel and forming a "double loop", by means of two contact straps 100 disposed at horizontal center line 105 of double loop 200, according to variations of the present invention. Reference is also made to FIG. 8*b*, which is an example illustration of a row of plurality of double loops 200 forming upper meandering path 146*a* and lower meandering path 146*b*.

In variations of the present inventions, for example, in variable resistors having several parallel meanders 148, the row of contact straps 100 can be disposed outside of all meanders 148 or between two adjacent ones.

Figure 10A:
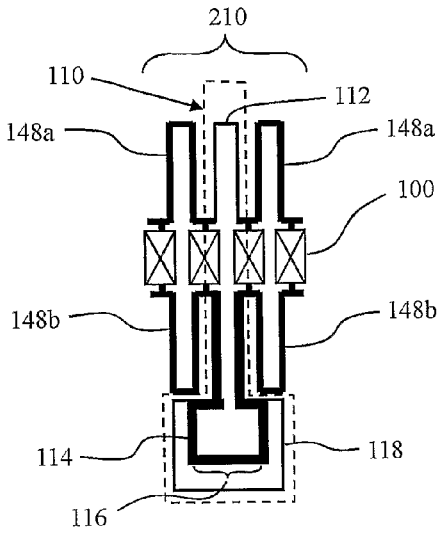
FIG. 10*a* illustrates a module of three double loops, wherein the right and the left double loops have constant resistance, and wherein the resistance of the middle double loop can be increased by trimming.

FIG. 10*a* illustrates module 210, having three double loops, wherein the right and the left double loops 148 have constant resistance, and middle double loop 110 has resistance that can be increased by trimming: cutting shunting bar 116 disposed at the bottom of inner loop 114. The trimming is performed (typically by a laser) to bring the resistance value of the individual meanders 110, and thereby the resistance value of the trimmed individual modules 210 and the resistive path, to a predefined precise target value and to improve the linearity of the relationship between the wiper's position and the electrical output.

In the illustration shown in FIG. 10*a*, upper loop 112 of middle double loop 110, bypass loop 118 and lower inner loop 114 with shunting bar 116 are shown with different widths of resistive lines. This is done in order to get, before trimming the double loop 110, a lower resistance value than the resistance of the adjacent, non-trimmable double loops 148 in module 210 and a higher resistance value after trimming. Thereby, the nonlinearity, within a module due to a difference in resistance between trimmable and non-trimmable double loops is reduced.

Figure 10B:
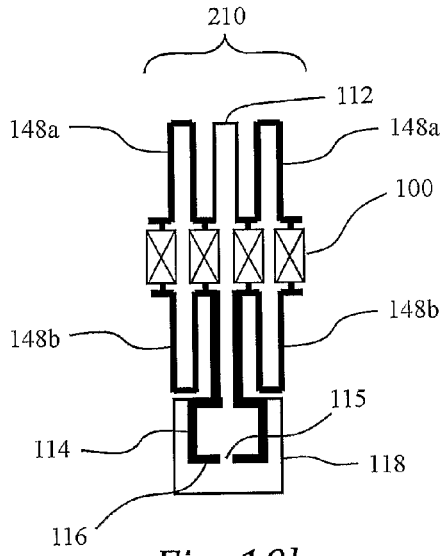
FIG. 10*b* illustrates the module shown in FIG. 10*a*, whereas the shunting bar disposed at the bottom of the middle double loop is cut.

FIG. 10*b* illustrates module 210, whereas shunting bar 116 disposed at the bottom of middle double loop 114 is cut, thereby creating a gap 115. While before the cutting of shunting bar 116, current went through both bypass loop 118 and lower inner loop 114, after the cutting of shunting bar 116, current goes through only bypass loop 118, thereby increasing the resistance of middle double loop 110.

The trimming method for increasing the resistance of a small segment of the resistive path (between two adjacent contact straps 100) ensures a high stability when compared with a common method of a laser beam cutting into the resistive layer, as described in '845. Cutting shunting bar 116 forces the current far from the cut. There is no current in the heat affected zone and no resistance drift after a laser cut, as is the case in the method described in '845. Hence, the cutting of shunts is a preferable method in trimming precision resistors and is introduced by the present invention for trimming precision variable resistors.

Figure 9:
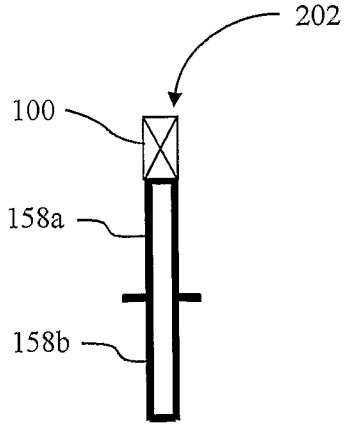
FIG. 9 is an example illustration of an individual double loop of a meandering resistive path, having a contact strap disposed on top of the double loop, according to variations of the present invention.

FIG. 9 is an example illustration of an individual double loop 202 of a meandering resistive path, having contact strap 100 disposed on top of top loop 158*a* of the double loop 202, according to variations of the present invention.

Figure 11A:
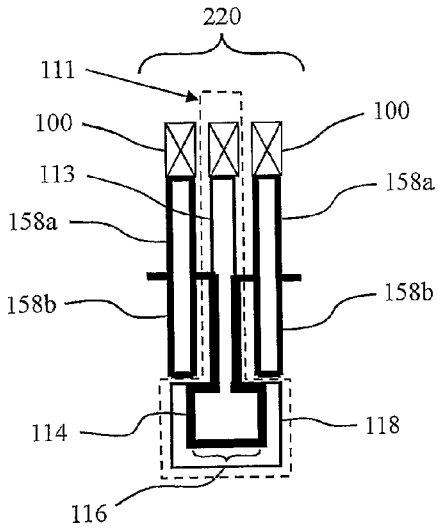
FIG. 11*a* illustrates a module similar to the three double loops, wherein the contact straps are disposed on top of the top end loop of each double loop.
Figure 11B:
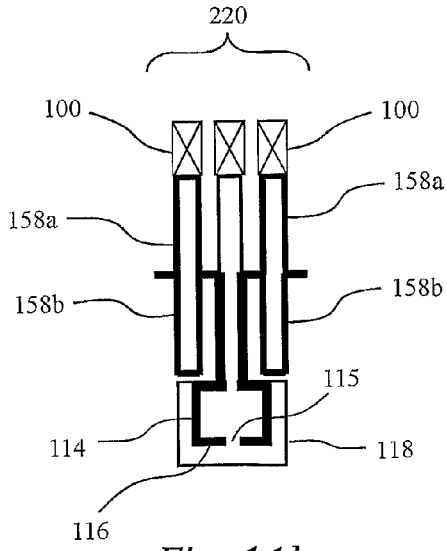
FIG. 11*b* illustrates the module shown in FIG. 11*a*, whereas the shunting bar disposed at the bottom of the middle double loop is cut.

FIG. 11*a* illustrates module 220, having three double loops, wherein contact straps 100 are disposed on top of upper loop 158*a* of left and right double loop 158 and on top of upper loop 113 of middle double loop 111. The right and the left double loops 158 have constant resistance, and middle double loop 111 has resistance that can be increased by trimming-cutting the shunting bar 116 and using bypasses 118. Similarly to module 210, FIG. 11*b* illustrates module 220, whereas shunting bar 116 disposed at the bottom of middle double loop 114 is cut, thereby creating gap 115 and using bypasses 118.

Figure 12A:
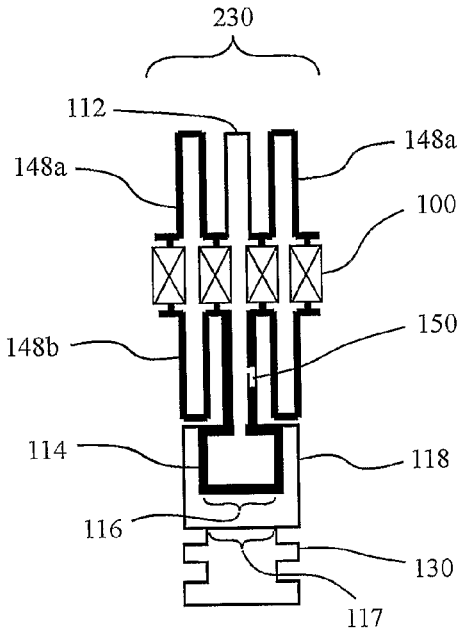
FIG. 12*a* illustrates a module of three double loops as in FIG. 10*a*, wherein the bottom of the middle double loop provides two discrete trimming steps, having two shunting bars and an analog cut for fine adjustment of resistance.
Figure 12B:
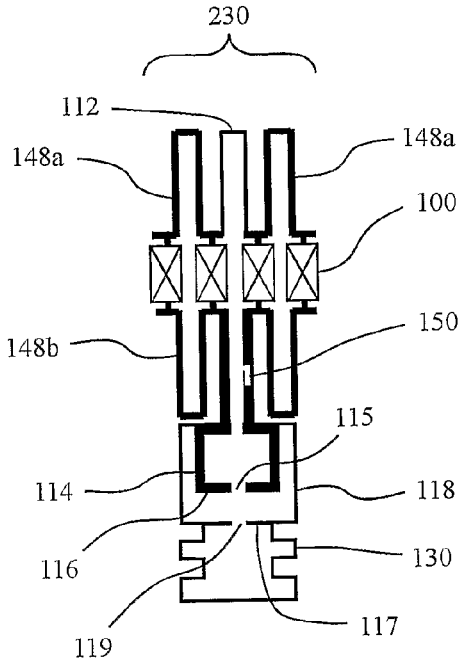
FIG. 12*b* illustrates the module shown in FIG. 12*a*, whereas both shunting bars disposed at the bottom of the middle double loop are cut.

FIG. 12*a* illustrates module 230 having three double loops as in module 210, wherein bottom loop of middle double loop 110 provides two discrete trimming steps with bypass loops 118 and 130, having two shunting bars (116 and 117 respectively) and an analog cut 150 for fine adjustment of resistance. A larger number of trimming steps can be provided if smaller discrete increments of resistance are needed. Furthermore, for final small increase of resistance the width of a line can be reduced by cut 150, typically performed by a laser. Similarly to module 220, FIG. 12*b* illustrates module 230, whereas shunting bars 116 and 117 disposed at the bottom of middle double loop 114 and bypass loop 118, respectively, are cut. Thereby, respective gaps 115 and 119 are created and bypass 130 is used to bypass the trimmed loops 114 and 118.

Increasing the number of trimming steps in a module permits addition of smaller increments for a fine adjustment of the resistance of the corresponding module. The trimming steps form a "ladder" and cutting of the rungs causes an increase of the module resistance. When the steps are similar in geometry, the increases can be easily made equal in the case of a single meander, but with two or more meanders in parallel, each consecutive increase in the length of the resistive path, when a rung is cut, causes a smaller change of resistance.

Figure 13:
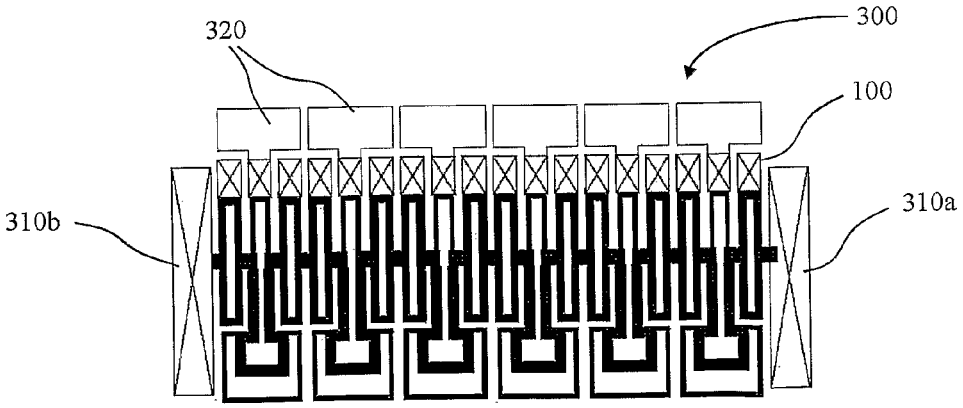
FIG. 13 illustrates an example complete track, having two meandering paths in parallel forming 6 modules (18 double loops), as shown in FIG. 11*a*, having the contact straps disposed on top of the top meandering resistive path and having a probing pad on top of each module and two end terminal pads for measuring the resistance during the trimming operation.

FIG. 13 illustrates an example complete meandering track 300, having two meandering paths in parallel, forming 6 modules (18 double loops) 220, having contact straps 100 disposed on top of the top meandering resistive path and optionally, having probing pads 320 disposed on top of each middle double loop 110 and two end terminal pads 310 for measuring the resistance during the trimming operation.

Contact straps 100 are of substantially even width and are disposed on the resistive path with substantially even gaps, and the number of contact straps 100 connected along the resistive path determines the resolution of the track, being the ratio between the resistance changes and the total resistance when the wiper is moved from a selected contact strap 100 to an immediate adjacent contact strap 100. In conventional variable resistors with wire-wound tracks, the resolution is determined by the jump of a wiper from one wire to the next, and in cermet or composition tracks, the resolution is determined by non-homogeneity of the materials. In designs based on the present invention, where the wiper travels from one contact strap 100 to the next, the resolution depends on the number of contact straps 100.

For the sake of ease of description, the drawings show a small number of contact straps 100 but potentiometers of the present invention may include hundreds, or thousands or any number of contact straps 100. For example, a potentiometer may contain 1000 contact straps 100 in 75 mm long track, which is rolled into a 24 mm diameter cylinder and bonded to the inside wall of the housing of a potentiometer of the present invention.

In variations of the present invention, meandering track 300 includes a plurality of probing pads 320, that are used for contacting with needle shaped probes the segments of the resistive path, mapping the resistance value of the resistive path and choosing which segments to trim in order to achieve the pre defined precise linearity and resistance value.

Figure 14:
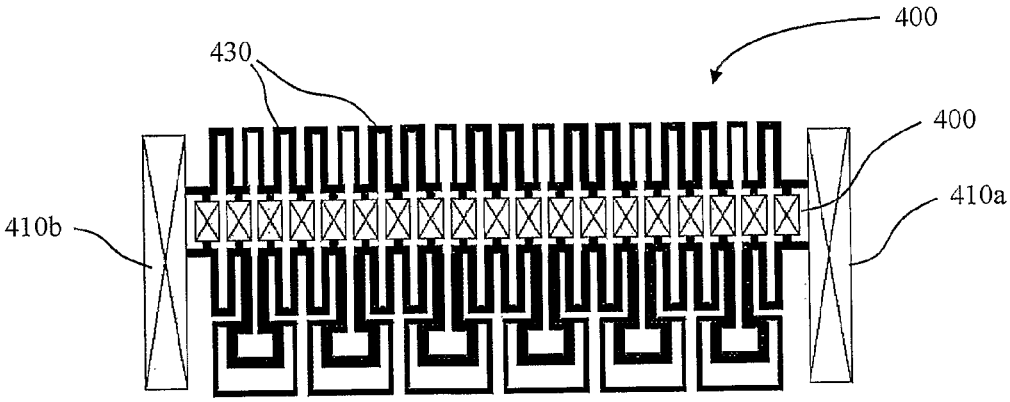
FIG. 14 illustrates an example complete track, having two meandering paths in parallel forming 6 modules (18 double loops), as shown in FIG. 10*a*, having the contact straps disposed between the top and bottom meandering resistive paths.

Reference is now made to FIG. 14, which illustrates an example complete track 400, having two meandering paths in parallel forming 6 modules (18 double loops) 210, having contact straps 100 disposed between the top and bottom meandering resistive paths. End terminal pads 410 are used for measuring the resistance during the trimming operation. This configuration provides an option of designing additional trimming steps or probing pads on top of upper loops 430.

Figure 15:
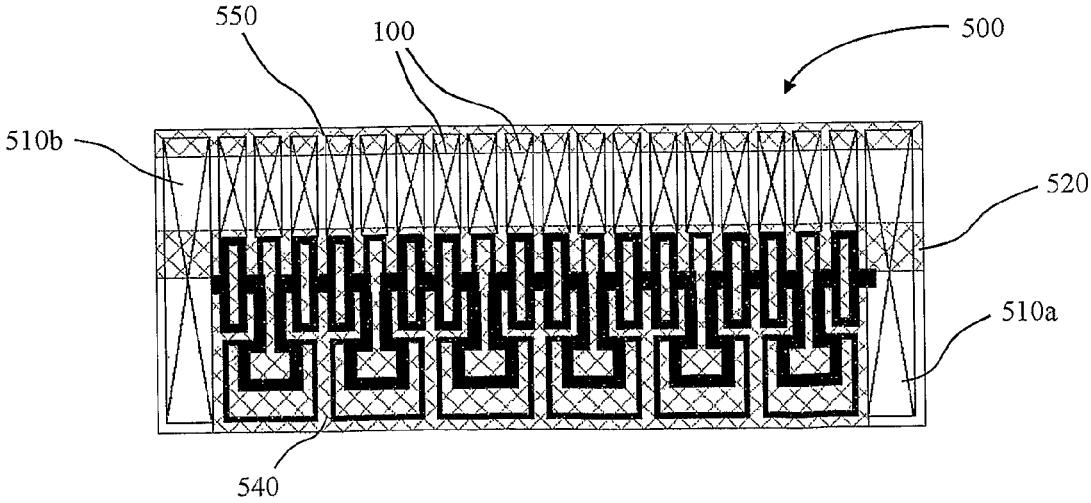
FIG. 15 illustrates an example complete track, having protective coating on the resistive pattern, a solder mask type coating on the two terminal pads for containing the lead-attach solder and a coating strip on top to reinforce the adhesion of the contact straps.

Reference is now made to FIG. 15 and also referring back to FIGS. 6*a*, 6*b* and 6*c*. FIG. 15 illustrates an example complete track 500, having protective coating 540 on the resistive pattern, a solder mask type coating 520 on two end terminal pads 510 for containing the lead-attach solder, in order to prevent solder penetration into wiper's path, when lead wires are soldered. Track 500 further includes a coating strip 550 on top to reinforce the adhesion of contact straps 100, which reinforces the adhesion of contact straps 100, where large thermal stresses occur with changing temperature due to differences in coefficients of thermal expansion between substrate 128 and resistive layer 126. The various types of coatings enhance the stability of the potentiometers by protecting against humidity and chemicals.

The invention being thus described in terms of embodiments and examples, it will be obvious that the same may be varied in many ways. Such variations are not to be regarded as a departure from the spirit and scope of the invention, and all such modifications as would be obvious to one skilled in the art are intended to be included within the scope of the claims.

What is claimed is:

1. A precision variable resistor including a track, two terminal pads respectively connected one at each end of the track, the precision variable resistor comprising a plurality of contact straps extending along said track between said terminal pads, wherein said track and said contact straps are made of a precision resistive layer, forming a resistive path, said resistive layer is attached to a substrate, wherein the resistive layer is patterned to form one or more meandering resistive paths, wherein the paths comprise shunting bars enabling calibration of the resistance by cutting of the shunting bars, wherein the cutting generates a heat-affected zone on the resistor, and the heat-affected zone does not affect a resistance value of the resistive path.

2. The precision variable resistor of claim 1, wherein said substrate of said track is made of isolating materials wherein said materials are selected from the group including rigid materials such as ceramic, flexible materials such as epoxy glass or another polymeric film or laminate, or a metal shim with an isolating film.

3. The precision variable resistor of claim 1, wherein said contact straps are disposed on said resistive path, substantially parallel to the longitudinal axis of said resistive path.

4. The precision valuable resistor of claim 1, wherein said contact straps are of substantially even width and are disposed on said resistive path with substantially even gaps.

5. The precision variable resistor of claim 1, wherein said contact straps are processed to provide an abrasion resistant surface.

6. The precision variable resistor of claim 5, wherein said process comprises plating said contact straps to provide low contact resistance, wherein said plating is selected from the group including alloys of gold and other metals used for plating electrical contacts.

7. The precision variable resistor of claim 1, wherein said resistive layer is thin film or foil, both materials of the type used for production of high precision fixed value resistors.

8. The precision variable resistor of claim 7, wherein said resistive layer of said thin film or foil and said substrate are selected based on the difference of coefficients of thermal expansion and the TCR of said resistive layer to provide a low TCR of the assembled variable resistor.

9. The precision variable resistor of claim 1, wherein said resistive layer is patterned to form at least one meandering resistive path between said two terminal pads to obtain an assembled resistive track having a predefined precise target resistance value between said terminal pads.

10. The precision variable resistor of claim 1, wherein said track further comprises probing pads for measuring segments of said resistive path for trimming purposes.

11. The precision variable resistor of claim 9, wherein said track further comprises a protective coating of said resistive path and a reinforcing coating of the edges of said contact straps.

12. The precision variable resistor of claim 1, wherein said track forms one of a straight line, an arcuate form, or is bent into a form of a cylinder.

13. A precision variable resistor including a track with a first end coupled to a first terminal pad and a second end coupled to a second terminal pad, the precision variable resistor comprising:

a plurality of contact straps extending between said first and second terminal pads, wherein said contact straps comprise a precision resistive layer and form a resistive path and wherein said contact straps have insignificant electrical resistance as compared to the track, wherein the resistive layer is patterned to form one or more meandering resistive paths, wherein the paths comprise shunting bars enabling calibration of the resistance by cutting of the shunting bars, wherein the cutting generates a heat-affected zone on the resistor, and the heat-affected zone does not affect a resistance value of the resistive path; and a wiper movably coupled to said plurality of contact straps, wherein said contact straps operatively provide an electrical connection between said wiper and locations along said resistive path during movement of said wiper on said contact straps.

14. The precision variable resistor of claim 1 wherein the contact straps operatively provide an electrical connection between a wiper and different locations along the resistive path during movement of the wiper on the contact straps.

15. The precision variable resistor of claim 14, wherein the electrical output during the travel of the wiper on the contact straps fits a specified output function, wherein the output function defines the relationship between the position of the wiper on the track and the electrical output.

16. The precision variable resistor of claim 14, wherein the resistive layer is patterned to form at least one meandering resistive path between the two terminal pads to obtain an assembled resistive track having a predefined precise target resistance value between the terminal pads.

17. The precision variable resistor of claim 16, wherein the at least one meandering resistive path comprises calibrating elements enabling the trimming of one or more of the at least one meandering resistive path, and thereby bring the resistance to a specified precise target and improve the fit of the electrical output of the travelling wiper to the output function.

18. The precision variable resistor of claim 16, wherein the trimming is performed by cutting into a resistive pattern to reduce the width of the conducting lines of the resistive pattern.

19. The precision variable resistor of claim 14, wherein the electrical connections connect one of the terminal pads and the wiper with an external circuit, wherein the lead wire of the non-connected terminal pad either remains not connected or is short-circuited with the terminal of the wiper, thereby forming a two-wire variable resistor.

20. The precision variable resistor of claim 14, wherein the electrical connections connect one of the terminal pads and the wiper with an external circuit, wherein a lead wire of a non-connected terminal pad is short-circuited with the terminal of the wiper, thereby forming a two-wire variable resistor, serving as a precision position sensor or motion transducer, based on a precise and stable resistance Rx formed between one terminal pad of the track and the wiper, wherein the resistance Rx is remotely connected in series with a precise and stable load resistor RL and with a constant voltage source Vs, forming a voltage divider; wherein movement of the wiper on the contact straps changes the rheostat resistance Rx from zero up to the total resistance Rt of the track; wherein the electric output is remotely sensed as voltage drop VL over the load resistor RL or as voltage drop Vx over the rheostat resistance Rx and wherein the recording of both VL and Vx indicate the proper functioning of the readout.

21. The precision variable resistor of claim 14 used in potentiometer mode, wherein the resistive path on the track forms a precise and stable resistance between two terminal pads of the track while the wiper moving on the resistive path provides a third terminal dividing the precise and stable resistance as a function of the position of the wiper.

* * * * *